US007172470B2

(12) United States Patent
Takaya et al.

(10) Patent No.: US 7,172,470 B2
(45) Date of Patent: Feb. 6, 2007

(54) TERMINAL DEVICE FOR ELECTRICAL EQUIPMENT

(75) Inventors: Kouetsu Takaya, Kanagawa (JP); Eiichiro Okada, Kanagawa (JP)

(73) Assignee: Fuji Electric Fa Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 10/539,575

(22) PCT Filed: Aug. 22, 2003

(86) PCT No.: PCT/JP03/10638

§ 371 (c)(1),
(2), (4) Date: Dec. 21, 2005

(87) PCT Pub. No.: WO2004/057703

PCT Pub. Date: Jul. 8, 2004

(65) Prior Publication Data

US 2006/0148335 A1 Jul. 6, 2006

(30) Foreign Application Priority Data

Dec. 19, 2002 (JP) ..... 2002-368222

(51) Int. Cl.
*H01R 4/36* (2006.01)

(52) U.S. Cl. ..... 439/811; 439/709; 439/718

(58) Field of Classification Search ..... 439/810–812, 439/709, 718

See application file for complete search history.

(56) References Cited

U.S. PATENT DOCUMENTS 4,790,778 A 12/1988 Seidenbusch
5,171,160 A * 12/1992 Beins et al. ..... 439/329
5,291,553 A * 3/1994 Smith ..... 379/413.04
5,727,314 A * 3/1998 Ashcraft ..... 29/884
5,739,467 A 4/1998 Fabrizi
5,846,101 A 12/1998 Duchemin et al.
6,361,381 B1 * 3/2002 Koebbe ..... 439/810
6,719,593 B2 * 4/2004 Garcia et al. ..... 439/811
2002/0081914 A1 6/2002 Takaya et al.
2002/0187685 A1 * 12/2002 Garcia et al. ..... 439/811
2003/0003811 A1 * 1/2003 Chadbourne ..... 439/718

FOREIGN PATENT DOCUMENTS

EP 0683498 A 11/1995
JP 51-99293 1/1976
JP 56-37471 4/1981
JP 5-347118 12/1993
JP 2707514 10/1997
JP 2000-222996 8/2000

* cited by examiner

*Primary Examiner*—Gary F. Paumen
(74) *Attorney, Agent, or Firm*—Rabin & Berdo, P.C.

(57) ABSTRACT

A charge section, for example a terminal metal fitting, pushing screw, metal retainer and terminal plate, is covered by an upper insulation case and a lower insulation case. An opening of the upper insulation case and openings of a lower insulation case in which a connection electric wire that is inserted are sealed, in a condition where an electric wire is not wired, by the superposition of insulation cases or a cover body. As a result, the charge section is prevented from being excessively exposed to protect the charge section from being contacted, regardless of whether the wiring is not yet performed or being performed.

2 Claims, 5 Drawing Sheets

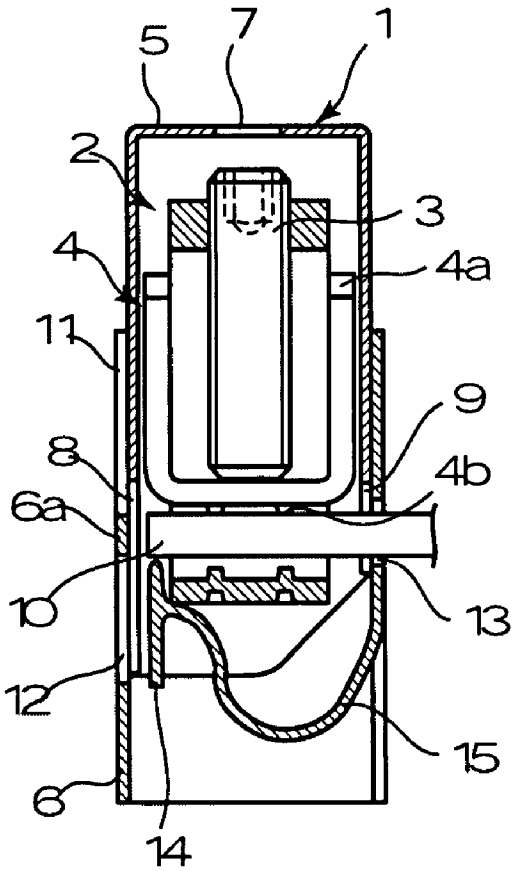
FIG. 1C
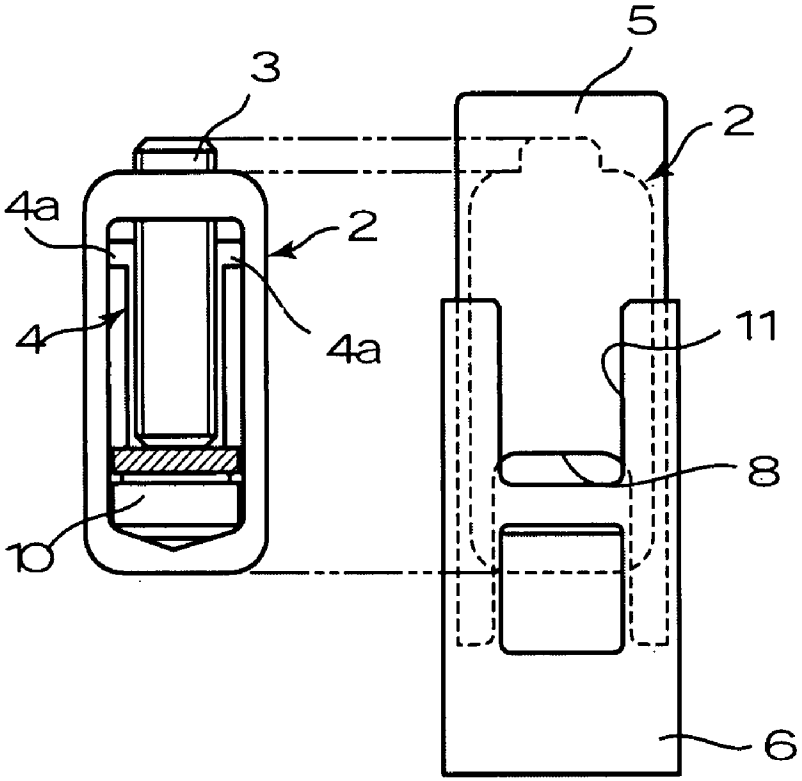
FIG. 1B
FIG. 1A

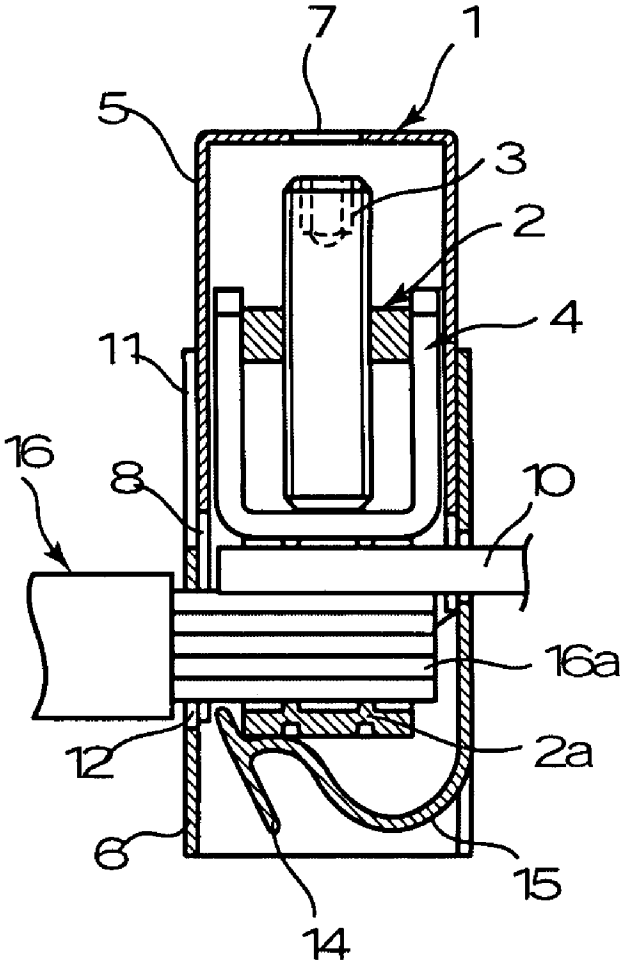
FIG. 2C
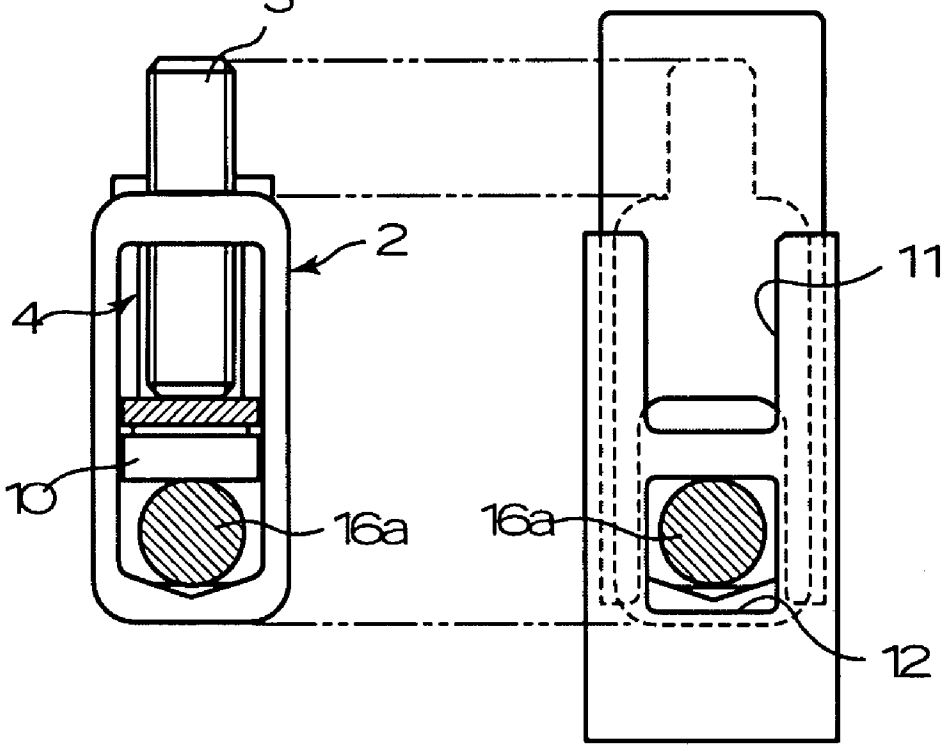
FIG. 2B
FIG. 2A

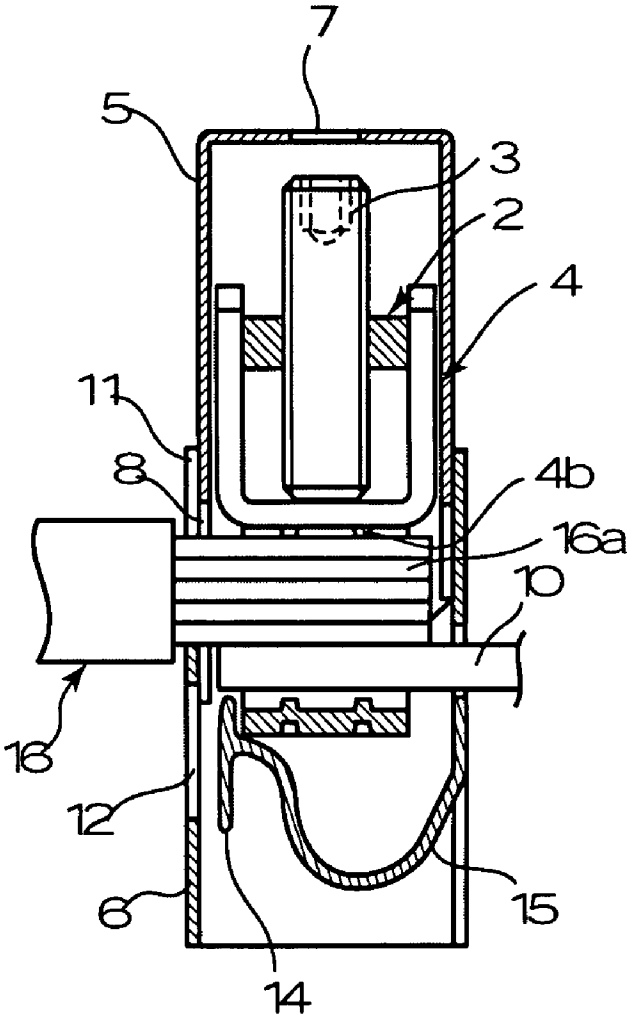
FIG. 3C
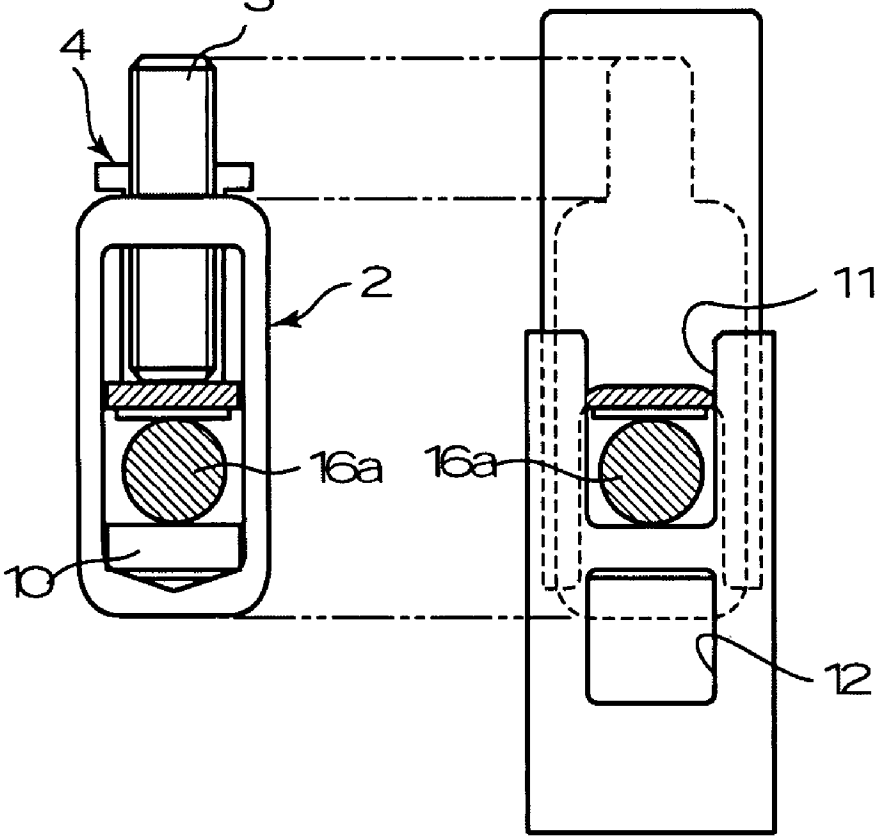
FIG. 3B
FIG. 3A

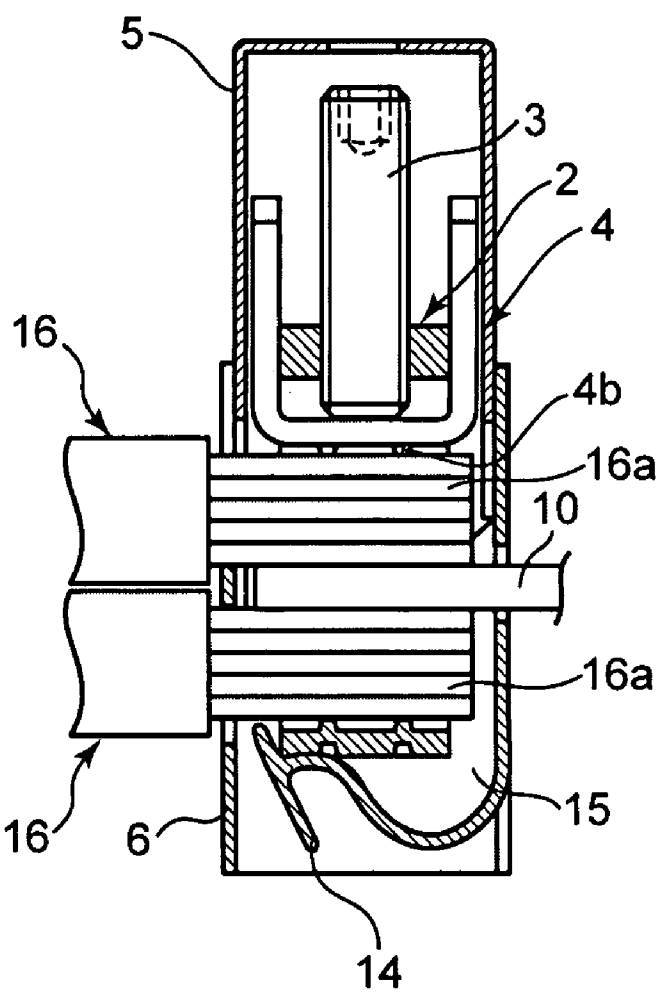
FIG. 4C
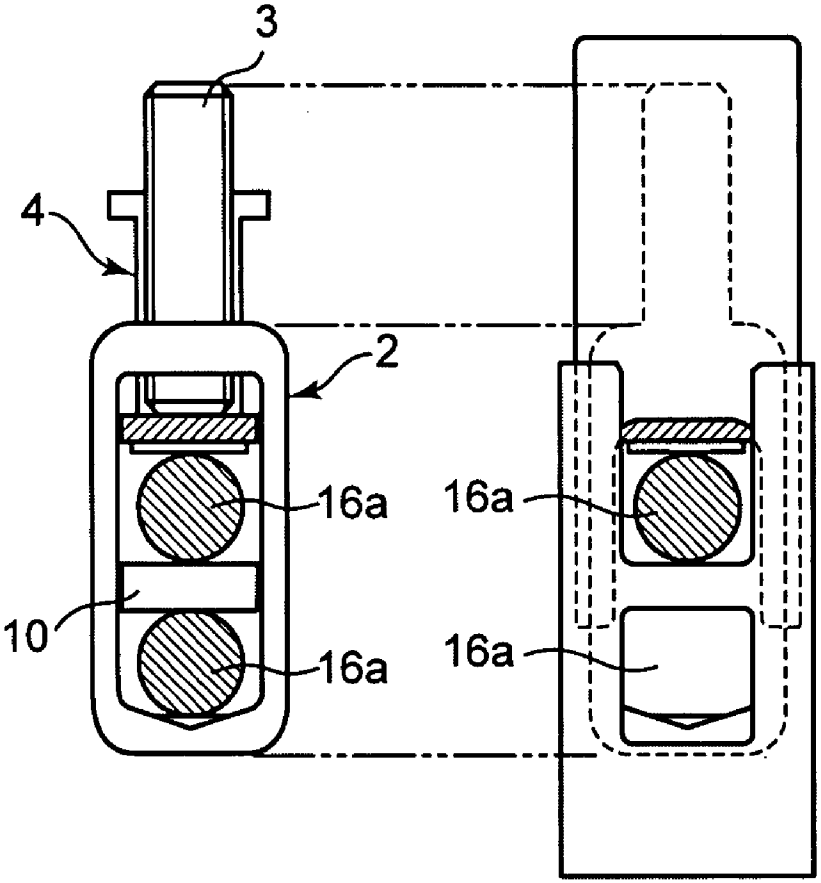
FIG. 4B
FIG. 4A

TERMINAL DEVICE FOR ELECTRICAL EQUIPMENT

TECHNICAL FIELD

The invention relates to a terminal apparatus for connecting an electric wire to a terminal plate of an electric device (e.g., electromagnetic contactor (relay), wiring breaker), and more specifically, to a terminal apparatus for protecting a charge section from contact.

PRIOR ART

A known terminal apparatus for protecting a charge section from contact is disclosed in Japanese Laid-Open Publication No. 5-347118. This terminal apparatus is designed so that the end section of a bolt for tightening an electric wire around a terminal plate projects from a nut for use in attaching a protection cover by a screw having a collar. However, this terminal apparatus is fitted with a protection cover only after the wiring is completed, thus causing a problem that the apparatus is not protected before or while the wiring is being performed. This apparatus also has a problem in that the front face side (electric wire insertion side) and the lower face side of the protection cover are exposed, and thus protection from the front and lower directions is not sufficient. Thus, it is an objective of the present invention to sufficiently protect such a charge section from being contacted by preventing the charge section from being exposed regardless of whether the wiring work is not yet performed or being performed.

DISCLOSURE SUMMARY OF THE INVENTION

In order to solve the above problems, the invention provides a terminal apparatus of an electric device, which includes a square-shaped terminal metal fitting and a pushing screw screwed into the upper side of this terminal metal fitting. A metal retainer is inserted between the tip end of this pushing screw and the lower side of the terminal metal fitting. An upper insulation case in the form of a hollow square cylindrical body has at the upper wall a screw tightening hole opposed to the pushing screw and having has a lower face having an opening and that. The upper hollow body covers the entirety of the terminal metal fitting, the pushing screw, and the metal retainer. A lower insulation case in the form of a hollow square cylindrical body has openings at the upper and lower faces and is slidably combined with the outer side of the upper insulation case. The upper insulation case is notched, at the lower section of the front face wall, to have an opening through which is inserted with the connection end of an electric wire connected to the upper face of a terminal plate of an electric device. The upper insulation case is notched also at the lower section of the back face wall, to have an opening through which is inserted with the terminal plate. The lower insulation case has, at the front face wall, one upper and one lower opening through which are respectively inserted the connection ends of the electric wire respectively connected to the upper face and the lower face of the terminal plate. The lower insulation plate also has, at the back face wall, an opening through which is inserted the terminal plate. An elastic support integrally extending from the back face wall has, at the tip end thereof, a cover body for sealing the lower side opening of the front face wall from within. The terminal apparatus is attached to the terminal plate via the openings of the back face walls of the upper insulation case and the lower insulation case. The pushing screw is used to tighten the connection end of the electric wire inserted between the metal retainer and the upper face of the terminal plate via the opening of the front face wall of the upper insulation case and the upper side opening of the front face wall of the lower insulation case. The pushing screw is used to tighten the connection end of the electric wire inserted between the lower side of the terminal metal fitting and the lower face of the terminal plate via the opening of the front face wall of the upper insulation case and the lower side opening of the front face wall of the lower insulation case. Then the lowered terminal metal fitting is used to push down the support to move the cover body to open the lower side opening of the front face wall of the lower insulation case. The openings of the upper insulation case and the lower insulation case in which the electric wire is not inserted are always sealed by the superimposition of these cases or the cover plate.

According to another aspect of the invention, a charge section (e.g., connection end section of terminal plate or electric wire, terminal metal fitting) is sufficiently covered by the upper and lower insulation cases, and wiring can be performed while the insulation cases are attached, thus sufficiently preventing contact with the charge section from being contacted. According to still another aspect of the invention of claim 1 in which the insulation cases cover the charge section to prevent contact therewith, the U-shaped metal retainer is combined with the terminal metal fitting to have an opening at the upper side, both leg sections of this metal retainer are abutted with the front and rear end faces of the terminal metal fitting in a slidable manner, and the outer side of these leg sections is covered by the upper insulation case. As a result, the upward and downward movements of the terminal metal fitting can be smoothly guided in the upper insulation case via the metal retainer, and the metal retainer having an opening at the upper side does not prevent the tightening operation of the pushing screw.

BRIEF DESCRIPTION OF THE DRAWINGS

FIGS. 1A, 1B and 1C show an embodiment of the invention, wherein FIG. 1A is a front view of a terminal metal fitting part in an unwired condition. FIG. 1B is a front view of a terminal apparatus, and FIG. 1C is a longitudinal sectional view of the terminal apparatus.

FIGS. 2A, 2B and 2C shows an embodiment of the invention an embodiment of the invention, wherein FIG. 2A is a front view of a terminal metal fitting part in a condition in which only the lower side of the terminal plate has a wire, FIG. 2B is a front view of a terminal apparatus, and FIG. 2C is a longitudinal sectional view of the terminal apparatus.

FIGS. 3A, 3B and 3C show an embodiment of the invention wherein FIG. 3A is a front view of a terminal metal fitting part in a condition in which only the upper side of the terminal plate is fitted with a wire, FIG. 3B is a front view of a terminal apparatus, and FIG. 3C is a longitudinal sectional view of the terminal apparatus.

FIGS. 4A, 4B and 4C show an embodiment of the invention, wherein FIG. 4A is a front view of a terminal metal fitting part in a condition in which both of the upper and lower sides of the terminal plate have a wire, FIG. 4B is a front view of a terminal apparatus, and FIG. 4C is a longitudinal sectional view of the terminal apparatus.

DETAILED DESCRIPTION OF THE PREFERRED EMBODIMENT

Figure 5:
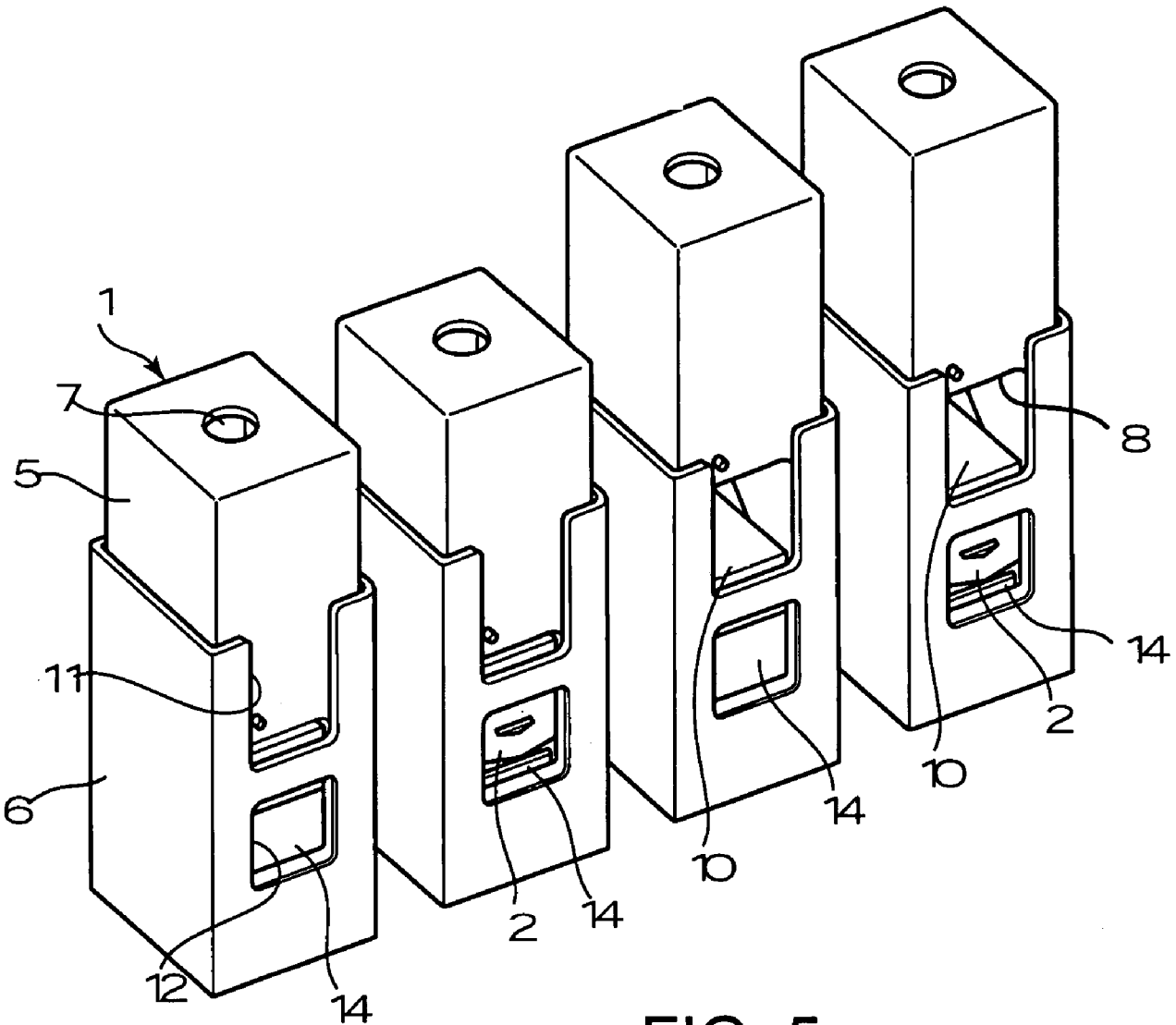
FIG. 5 is a perspective view illustrating the appearance of the terminal apparatuses in the respective conditions of FIGS. 1A to 4C.

Hereinafter, with reference to FIGS. 1A to 5, embodiments of the invention will be described. FIGS. 1A to 4C show the terminal apparatuses respectively in the unwired condition, a condition in which only the lower side of the terminal plate has a wire, a condition in which only the upper side of the terminal plate has a wire, and a condition in which wiring is present at both of the upper side and the lower side of the terminal plate. In these drawings, the figure numbers with suffix "A" show the front view of the terminal metal fitting part, the figure numbers with suffix "B" show the front view of the terminal apparatus, and the figure numbers with suffix "C" show the longitudinal sectional view. FIG. 5 is a perspective view illustrating the appearance of the terminal apparatus in the respective conditions in the order from left (however, the electric wire is omitted).

Firstly, in FIGS. 1A–1C and FIG. 5, a terminal apparatus 1 includes a square-shaped terminal metal fitting 2, a pushing screw 3 having a hexagonal hole that is screwed into the upper side thereof, and a U-shaped metal retainer 4 inserted between the tip end of the pushing screw 3 and the lower side of the terminal metal fitting 2. The apparatus further includes an upper insulation case 5 for covering the entirety of the terminal metal fitting 2, the pushing screw 3, and the metal retainer 4, and a lower insulation case 6 combined with the outer side in a slidable manner. The metal retainer 4 is combined with the terminal metal fitting 2 so as to open to the upper side. As shown in FIG. 1A, the metal retainer 4 abuts with via an arm section 4*a* projecting to the left and right of the upper end of both leg sections the front and rear end faces of the terminal metal fitting 2 in a slidable manner, via an arm section 4*a* projecting to the left and right of the upper end of both leg sections. The outer side of both leg sections is covered with the upper insulation case 5. The terminal metal fitting 2 is guided by the metal retainer 4 to move in upward and downward directions and the metal retainer 4 is positioned to be retained by the upper insulation case 5 via both leg sections. The inner face of the lower side of the terminal metal fitting 2 has a rib 2*a* having two grooves and the lower face of the metal retainer 4 also has a rib 4*b* having two grooves. The upper insulation case 5 is a resin-made hollow square cylindrical body having at the upper wall a circular screw tightening hole 7 opposed to the pushing screw 3, and an opening at the lower face. The lower section of the front face wall (left wall of FIG. 1C) of the upper insulation case 5 is notched to have an inverted U-shaped opening 8 and the back face wall (right wall of FIG. 1C) is notched to have a similarly-shaped opening 9 to the same depth. The front face wall of the upper insulation case 5 has a longer length in the lower direction than that of the back face wall, thus allowing the opening 8 to be deeper than the opening 9 by the difference in length. As described later, the opening 8 is inserted with the connection end of an electric wire connected to the upper face of the terminal plate 10 of an electric device, for example, an electromagnetic contactor (relay), not shown, is inserted in the opening 8. The opening 9 enables a terminal plate 10 to be inserted, as shown in the drawing. On the other hand, the lower insulation case 6 is also a resin-made hollow square cylindrical body in which the upper and lower faces have openings. As a result, the front face wall of the lower insulation case 6 has two openings, namely an upper opening 11 and a lower opening 12, and the back face wall has an opening 13. The opening 11 of the front face wall is notched to have a U-shape from the upper end face while the opening 12 is notched to have a square shape. The opening 13 of the back face wall has a long rectangular shape that is provided at the height opposed to the wall section 6*a* left between the opening 11 and the opening 12 of the front face wall.

As described later, the opening 11 of the front face wall is inserted with the connection end of the electric wire connected to the upper face of the terminal plate 10 while the opening 12 is similarly inserted in the opening 11 of the front face wall, while similarly with the connection end of the electric wire connected to the lower face is inserted in the opening 12. As shown in the drawing, the terminal plate 10 is inserted in the opening 13 of the back face wall is inserted with the terminal plate 10. In the condition of FIG. 1 FIGS. 1A, 1B and 1C where no electric wire is inserted, the lower insulation case 6 has a cover body 14 for sealing the opening 12 from within. The cover body 14 is integrated with the tip end of a strip-shaped support 15 extending from the back face wall and having the same width as that of the cover body 14. As described below, the support 15 has elasticity so as to be deformed easily when being pushed by the terminal metal fitting 2. When the terminal apparatus 1 is assembled as shown in the condition of FIG. 1 FIGS. 1A, 1B and 1C, the terminal metal fitting 2 attached with the pushing screw 3 is assembled with the metal retainer 4 and then the entirety thereof is inserted to the upper insulation case 5 to subsequently insert this upper insulation case 5 to the lower insulation case 6. This Also as shown in these figures, this assembly of the terminal apparatus 1 is attached, as shown in FIG. 1, to the terminal plate 10 via the opening 9 of the upper insulation case 5 and the opening 13 of the lower insulation case 6. FIG. 1 shows the unwired condition in which the The opening 11 of the lower insulation case 6 is sealed by the superimposed part with the upper insulation case 5, while the opening 8 of the upper insulation case 5 and the opening 12 of the lower insulation case 6 are sealed by the cover plate 14. The lower face of the lower insulation case 6 is covered by the cover body 14 and the support 15. Furthermore, the end face of the terminal plate 10 is covered by the wall section 6*a* of the lower insulation case 6. On the other hand, the size of the screw tightening hole 7 is that a finger cannot enter it. The lower face of the lower insulation case 6 is covered by the cover body 14 and the support 15.

Furthermore, the end face of the terminal plate 10 is covered by the wall section 6*a* of the lower insulation case 6. On the other hand, the size of the screw tightening hole 7 is such that a finger cannot enter it.

This allows a charge section (i.e., terminal metal fitting 2, pushing screw 3, metal retainer 4, terminal plate 10) to be sufficiently covered by the upper and lower insulation cases 5 and 6, thus preventing so as to eliminate the risk of electric shock due to an accidental contact.

FIGS. 2A to 2C and the second diagram from the left in FIG. 5 show the terminal apparatus 1 in which only the lower side of the terminal plate 10 has a wiring wire. In order to provide the wiring as shown in the drawings, the pushing screw 3 is loosened via the screw tightening hole 7 to lower the terminal metal fitting 2. As a result, the support 15 of the cover body 14 is pushed down to the terminal metal fitting 2 to open the openings 8 and 12. Then, the connection end 16*a* of the electric wire 16 is inserted between the lower face of the terminal plate 10 and the lower side of the terminal metal fitting 2 and the pushing screw 3 is rotated to tighten the connection end 16*a* via the rib 2*a*. In this condition, the opening 11 of the lower insulation case 6 is sealed by the superimposed part with the upper insulation case 5, as with the unwired condition. The support 15 has elasticity by which, when the terminal metal fitting 2 is elevated (or recessed), the support 15 returns to the condition of FIGS. 1A to 1C together with the cover body 14.

FIGS. 3A to 3C and the third diagram from the left in FIG. 5 show the terminal apparatus 1 in which only the upper side of the terminal plate 10 has a wiring wire. In order to provide the wiring as shown in the drawings, the pushing screw 3 is loosened to raise the metal retainer 4 together with the upper insulation case 5. As a result, the opening 11 of the lower insulation case 6 is opened while being superimposed aligned with the opening 8 of the upper insulation case 5. Then, the connection end 16*a* of the electric wire 16 is inserted, via the openings 11 and 8, between the upper face of the terminal plate 10 and the metal retainer 4 and the pushing screw 3 is rotated to tighten the connection end 16*a* via the rib 4*b*. In this condition, the opening 12 of the lower insulation case 6 is sealed by the cover body 14, as with the unwired condition. FIGS. 4A to 4C and the first diagram from the right in FIG. 5 show the terminal apparatus 1 in which wiring is present at both of the upper and lower sides of the terminal plate 13 have a wiring. The shown wiring is provided by further loosening the pushing screw 3 to the condition that is looser than that shown in FIGS. 2A to 2C or FIGS. 3A to 3C to raise the upper insulation case 5 and by lowering the terminal metal fitting 2 to open the openings 11 and 12 of the lower insulation case 6 at the same time and the first diagram from the right in FIG. 5 show the terminal apparatus 1 in which both of the upper and lower sides of the terminal plate 13 have a wiring. The shown wiring is provided by further loosening the pushing screw 3 to the condition that is looser than that shown in FIGS. 2A to 2C or FIGS. 3A to 3C to raise the upper insulation case 5 and by lowering the terminal metal fitting 2 to open the openings 11 and 12 of the lower insulation case 6 at the same time.

Thus, as described above, according to this invention, the upper insulation case and the lower insulation case for covering the charge section have openings that are always sealed when a wiring is not provided and the minimum number of openings are provided only when a wiring is provided. As a result, an accidental electric shock is securely reliably prevented regardless of whether the wiring work is not yet performed or being performed.

The invention claimed is:

1. A terminal apparatus of an electric device, comprising:

a square-shaped terminal metal fitting;

a pushing screw screwed into an upper side of the terminal metal fitting;

a metal retainer inserted between a tip end of the pushing screw and a lower side of the terminal metal fitting;

an upper insulation case, including a hollow square cylindrical body having at an upper wall a screw tightening hole opposed to the pushing screw and having an opening at a lower face, the upper insulation case enclosing the entirety of the terminal metal fitting, the pushing screw, and the metal retainer; and a lower insulation case, including a hollow square cylindrical body having openings at upper and lower faces thereof and being slidably combined with an outer surface of the upper insulation case, wherein:

the upper insulation case is notched, at a lower section of a front face wall thereof, to have an opening for insertion of a connection end of an electric wire for connection to an upper face of a terminal plate of an electric device, and is notched at a lower section of a back face wall, to have an opening for insertion of the terminal plate;

the lower insulation case has, at a front face wall thereof, one upper and one lower opening for insertion respectively of the connection end of the electric wire for connection to the upper face and a connection end of an electric wire for connection to a lower face of the terminal plate, and has, at a back face wall thereof, an opening for insertion of the terminal plate, an elastic support integrally extending from the back face wall, the elastic support having, at the tip end thereof, a cover body for sealing from an inner side the lower side opening of the lower insulation case front face wall;

the terminal apparatus is attachable to the terminal plate via the openings of the back face walls of the upper insulation case and the lower insulation case;

the pushing screw serves to tighten the connection end of the electric wire inserted between the metal retainer and the upper face of the terminal plate via the opening of the front face wall of the upper insulation case and the upper side opening of the front face wall of the lower insulation case;

the pushing screw serves to tighten the connection end of the electric wire inserted between the lower side of the terminal metal fitting and the lower face of the terminal plate via the opening of the front face wall of the upper insulation case and the lower side opening of the front face wall of the lower insulation case, and then the lowered terminal metal fitting serves to push down the support to move the cover body so as to open the lower side opening of the front face wall of the lower insulation case; and the openings of the upper insulation case and the lower insulation case in which the electric wire is not inserted are always sealed by the superimposition of these cases or the cover plate.

2. A terminal apparatus of an electric device according to claim 1, wherein the metal retainer is U-shaped and is combined with the terminal metal fitting to have an opening at an upper side, both leg sections of this metal retainer abut the front and rear end faces of the terminal metal fitting in a slidable manner, and the upper insulation case covers the outer side of these leg sections.

* * * * *